US005871336A

United States Patent [19]

Young

[11] Patent Number: 5,871,336

[45] Date of Patent: Feb. 16, 1999

[54] THERMAL TRANSPIRATION DRIVEN VACUUM PUMP

[75] Inventor: Robert M. Young, Pittsburgh, Pa.

[73] Assignee: Northrop Grumman Corporation, Los Angeles, Calif.

[21] Appl. No.: 685,887

[22] Filed: Jul. 25, 1996

[51] Int. Cl.[6] ..... F04B 19/24; F04B 3/00

[52] U.S. Cl. ..... 417/207; 417/244

[58] Field of Search ..... 417/207, 244

[56] References Cited

U.S. PATENT DOCUMENTS

| | | | |
|---|---|---|---|
| 4,640,667 | 2/1987 | Trepp | 417/244 |
| 4,938,742 | 7/1990 | Smits . | |
| 5,386,115 | 1/1995 | Friedhoff et al. . | |
| 5,466,932 | 11/1995 | Young et al. . | |

OTHER PUBLICATIONS

"An Electronically Controlled Piezoelectric Insulin Pump and Valves" by W.J. Spencer,, Wayne Corbett, L.R. Dominguez and Blynn Shafer, *IEEE Transactions on Sonics and Ultrasonics,* vol. Su–25, No. 3, May 1978.

"A Piezoelectric Micropump Based on Micromachining of Silicon" by H.T.G. Van Lintel, F.C.M. Van DePol and S. Bouwstra, *Sensors and Actuators,* pp. 157–167, 1988.

"Piezoelectric Micropump with Three Valves Working Peristaltically" by Jan G. Smits, *Sensors and Actuators,* pp. 203–206, 1990.

"A Thermopneumatic Micropump Based on Micro–engineering Techniques" by F.C.M. Van De Pol, H.T.G. Van Lintel M. Elwenspoek and J.H.J. Fluitman, *Sensors and Actuators,* pp. 198–202, 1990.

"A Thermo–Pneumatic Actuation Principle for a Microminiature Pump and Other Micromechanical Devices" by F.C.M. Van DePol, D.G.J. Wonnink, M. Elwenspoek and J.H.J. Fluitman, *Sensors and Actuators,* pp. 139–143, 1989.

"Eine Revision der Gleichgewichtsbedingung der Gase" by Martin Knudsen, pp. 205–229, 1910.

"A Study of Thermal Transpiration Using Ultrahigh–Vacuum Techniques" by T. Edmonds and J.P. Hobson Jan., 1965.

"Measurements on an Experimental Model of a New 'Thermal Gradient' Vacuum Pump" by B.W. Schumacher, H.R. Falckenberg and U. Thiede, *Canadian Journal of Physics,* vol. 42, Feb., 1964.

"A Study of Thermal Transpiration for the Development of a New Type of Gas Pump" by E.J. Hopfinger and M. Altman *Journal of Engineering for Power,* vol. 91, Jul., 1969.

"The Application of Thermal Transpiration to a Gaseous Pump" by P.A. Orner and G.B. Lammers *Journal of Basic Engineering,* Jun., 1970.

"A Mathematical Analysis of a Thermal Transpiration Vacuum Pump" by D.J. Turner, 1966.

*Primary Examiner*—Bibhu Mohanty
*Attorney, Agent, or Firm*—Walter G. Sutcliff

[57] ABSTRACT

A micro-machined vacuum pump is provided which may be utilized with microsensors. The pump in accordance with the present invention is preferably fabricated within a semiconductor substrate and utilizes thermal transpiration to provide compression. The pump has a plurality of flow chambers and a plurality of flow tubes to interconnect the flow chambers. The pump additionally includes means for creating a temperature differential between a first end and a second end of each flow tube to draw the gas therethrough. Drawing the gas through the flow tube increases the pressure within an adjacent flow chamber and induces a pumping action.

18 Claims, 6 Drawing Sheets

THERMAL TRANSPIRATION DRIVEN VACUUM PUMP

BACKGROUND OF THE INVENTION

1. Field of the Invention

This invention relates to a vacuum pump, and more particularly, to a vacuum pump for the low pressure pumping of fluids which may be used with microsensors and a mass-spectrograph in particular.

2. Description of the Prior Art

Various devices are currently available for determining the quantity and type of molecules present in a gas sample. One such device is the mass-spectrograph.

Mass-spectrographs determine the quantity and type of molecules present in a gas sample by measuring their masses. This is accomplished by ionizing a small sample and then using electric and/or magnetic fields to find a charge-to-mass ratio of the ion. Current mass-spectrographs are bulky, bench-top sized instruments. These mass-spectrographs are heavy (100 pounds) and expensive. Their big advantage is that they can be used in any environment.

Another device used to determine the quantity and type of molecules present in a gas sample is a chemical sensor. These can be purchased at a low cost, but these sensors must be calibrated to work in a specific environment and are sensitive to a limited number of chemicals. Therefore, multiple sensors are needed in complex environments.

A need existed for a low-cost gas detection sensor that will work in any environment. U.S. Pat. No. 5,386,115, hereby incorporated by reference, discloses a solid state mass-spectrograph which can be implemented on a semiconductor substrate.

FIG. 1 illustrates a functional diagram of such a mass-spectrograph 1. This mass-spectrograph 1 is capable of simultaneously detecting a plurality of constituents in a sample gas. This sample gas enters the spectrograph 1 through dust filter 3 which keeps particulate from clogging the gas sampling path. This sample gas then moves through a sample orifice 5 to a gas ionizer 7 where the gas is ionized by electron bombardment, energetic particles from nuclear decays, or in an electrical discharge plasma. Ion optics 9 accelerate and focus the ions through a mass filter 11. The mass filter 11 applies a strong electromagnetic field to the ion beam.

Mass filters which utilize primarily magnetic fields appear to be best suited for the miniature mass-spectrograph since the required magnetic field of about 1 Tesla (10,000 gauss) is easily achieved in a compact, permanent magnet design. Ions of the sample gas that are accelerated to the same energy will describe circular paths when exposed in the mass-filter 11 to a homogenous magnetic field perpendicular to the ion's direction of travel. The radius of the arc of the path is dependent upon the ion's mass-to-charge ratio.

The mass-filter 11 is preferably a Wien filter in which crossed electrostatic and magnetic fields produce a constant velocity-filtered ion beam 13 in which the ions are disbursed according to their mass/charge ratio in a dispersion plane which is in the plane of FIG. 1.

A vacuum pump 15 creates a vacuum in the mass-filter 11 to provide a collision-free environment for the ions. This vacuum is needed in order to prevent error in the ion's trajectories due to these collisions.

The mass-filtered ion beam is collected in a ion detector 17. Preferably, the ion detector 17 is a linear array of detector elements which makes possible the simultaneous detection of a plurality of the constituents of the sample gas. A microprocessor 19 analyses the detector output to determine the chemical makeup of the sampled gas using well-known algorithms which relate the velocity of the ions and their mass.

The results of the analysis generated by the microprocessor 19 are provided to an output device 21 which can comprise an alarm, a local display, a transmitter and/or data storage. The display can take the form shown at 21 in FIG. 1 in which the constituents of the sample gas are identified by the lines measured in atomic mass units (AMU).

Preferably, a mass-spectrograph 1 is implemented in a semiconductor chip 23 as illustrated in FIG. 2. In the preferred spectrograph 1, chip 23 is about 20 mm long, 10 mm wide and 0.8 mm thick.

Chip 23 comprises a substrate of semiconductor material formed in two halves 25*a* and 25*b* which are joined along longitudinally extending parting surfaces 27*a* and 27*b*. The two substrate halves 25*a* and 25*b* form at their parting surfaces 27*a* and 27*b* an elongated cavity 29. This cavity 29 has an inlet section 31, a gas ionizing section 33, a mass filter section 35, and a detector section 37. A number of partitions 39 formed in the substrate extend across the cavity 29 forming chambers 41. These chambers 41 are interconnected by aligned apertures 43 in the partitions 39 in the half 25*a* which define the path of the gas through the cavity 29.

A vacuum pump 15 may be connected to each of the chambers 41 through lateral passages 45 formed in the confronting surfaces 27a and 27*b*. This arrangement provides differential pumping of the chambers 41 and makes it possible to achieve the pressures and pump displacement volume or pumping speed required in the mass filter 11 and detector sections with a miniature vacuum pump 15.

In order to evacuate cavity 29 and draw a sample of gas into the spectrograph 1, the vacuum pump 15 must be capable of operation at very low pressures. Moreover, because of size constraints, vacuum pump 15 is preferably micro-miniature in size.

Although a number of prior art micro-pumps have been described, these pumps have generally focused on the pumping of liquids. In addition, micro-pumps have been used to pump gases near or higher than atmospheric pressure. Moreover, such micro-pumps are fabricated by bulk micro-machining techniques wherein several silicon or glass wafers are bonded together. This is a cumbersome procedure which is less than fully compatible with integrated circuit applications.

Other conventional micro-pumps utilize moving parts such as diaphragms and rotating or sliding shaft feedthroughs. Such micro-pumps are subject to wear and replacement. Conventional piston pumps may introduce undesired pulsations into the gas pressure and flow and may be relatively noisy. Furthermore, some conventional pumps require oil for lubrication and the oil may react with the gases being pumped.

Conventional dynamic vacuum pumps have been constructed which utilize thermal transpiration to obtain pressure rises. Thermal transpiration is discussed in Knudsen, M., *Eine Revision der Gleichgewichtsbedingung der Gase*, Annalen der Physik, 31, 205–229 (1910), which is incorporated herein by reference.

Thermal transpiration may be described in the context of two large volumes $V_c$, $V_H$ of length L which are interconnected by a small tube having a radius R. Under equilibrium conditions, and for a continuum flow regime (where the mean free path length of the molecules is much smaller than the length of the large volumes; i.e. $\lambda << L$) then the pressure in both volumes will be the same and the density related to the temperature ratio, namely $P_C = P_H$ and $\rho_H/\rho_C = T_C/T_H$ However, if the radius R of the small tube is sized such that the gas inside it is in a free molecular flow regime (i.e. $R << \lambda$) and the two volumes are still in a continuum regime, then the pressures in the two volumes are related by $P_H/P_C = (T_H/T_C)^{1/2}$ and $P_H/P_C = (T_C/T_H)^{1/2}$ For example, for a temperature difference of 600K and 300K, the hot side pressure is $2^{1/2} = 1.414$ greater than the cold side pressure.

Further, multiple stages may be strung together to produce a significant pressure rise. Specifically, for N stages $P_{high}/P_{low} = (T_H/T_C)^{N/2}$ This relationship applies even when the tube length is shortened to such a degree that only a thin aperture connects the two volumes provided that the gas inside the tube is in a free molecular flow regime and the two volumes are still in a continuum regime.

Conventional pumps which utilize thermal transpiration are macroscopic bench-top or larger units which have been laboriously fashioned.

SUMMARY OF THE INVENTION

A micro-machined vacuum pump is provided which may pump fluids at low pressure and may be utilized with microsensors. The pump in accordance with the present invention is preferably fabricated within a semiconductor substrate and utilizes thermal transpiration to provide compression. The pump has a plurality of flow chambers and a plurality of flow tubes to interconnect the flow chambers. The semiconductor substrate may include a lid for forming the flow chambers and flow tubes.

The pump additionally includes means for creating a temperature differential between a first end and a second end of each flow tube to draw the gas therethrough. Drawing the gas through the flow tube increases the pressure within an adjacent flow chamber and induces a pumping action. The means may preferably include a heater adjacent to the second end of each flow tube for applying heat thereto. Each of the heaters may be supported by an air bridge within each flow chamber.

The pump includes an inlet port and an outlet port. The pump receives a fluid at a first pressure through the inlet port and releases the fluid through the outlet port at a second pressure.

Preferably, each of the flow tubes may have a rectangular cross section and at least one dimension of each flow tube is approximately equal to or less than the mean free path length of the fluid. Alternatively, the flow chambers may be formed as concentric circles within the semiconductor substrate. Further, the flow tubes may be formed as a porous film membrane.

The pump may additionally include a heat sink connected to the semiconductor substrate to dissipate the heat therein to create a temperature differential across each of the flow tubes.

The pump in accordance with the present invention does not utilize moving parts which are subject wear and require replacement. In addition, the pump includes a system of redundancy to provide reliable operation. The pump does not introduce undesired pulsations into the gas pressure and flow. Furthermore, the pump does not require oil for operation and lubrication which may react with the gases being pumped.

A complete understanding of the invention will be obtained from the following description and the accompanying figures.

DETAILED DESCRIPTION OF THE PREFERRED EMBODIMENTS

Many types of microsensors require a gas sample to be drawn inside of the sensor. In particular, the mass-spectrograph 1 requires a gas sample, reduced in pressure to the range of 1–10 milliTorr. An on-chip vacuum pump 15, manufacturable with silicon integrated circuit technology and thus compatible with the mass-spectrograph 1 is preferred. The vacuum pump 15 in accordance with the present invention may additionally be utilized with other integrated circuit microsensors including miniature gas chromatographs, pre-concentrators, oxygen sensors, hydrocarbon sensors, pesticide sensors, chemical war agent sensors, mercury vapor sensors and the like.

Figure 1:
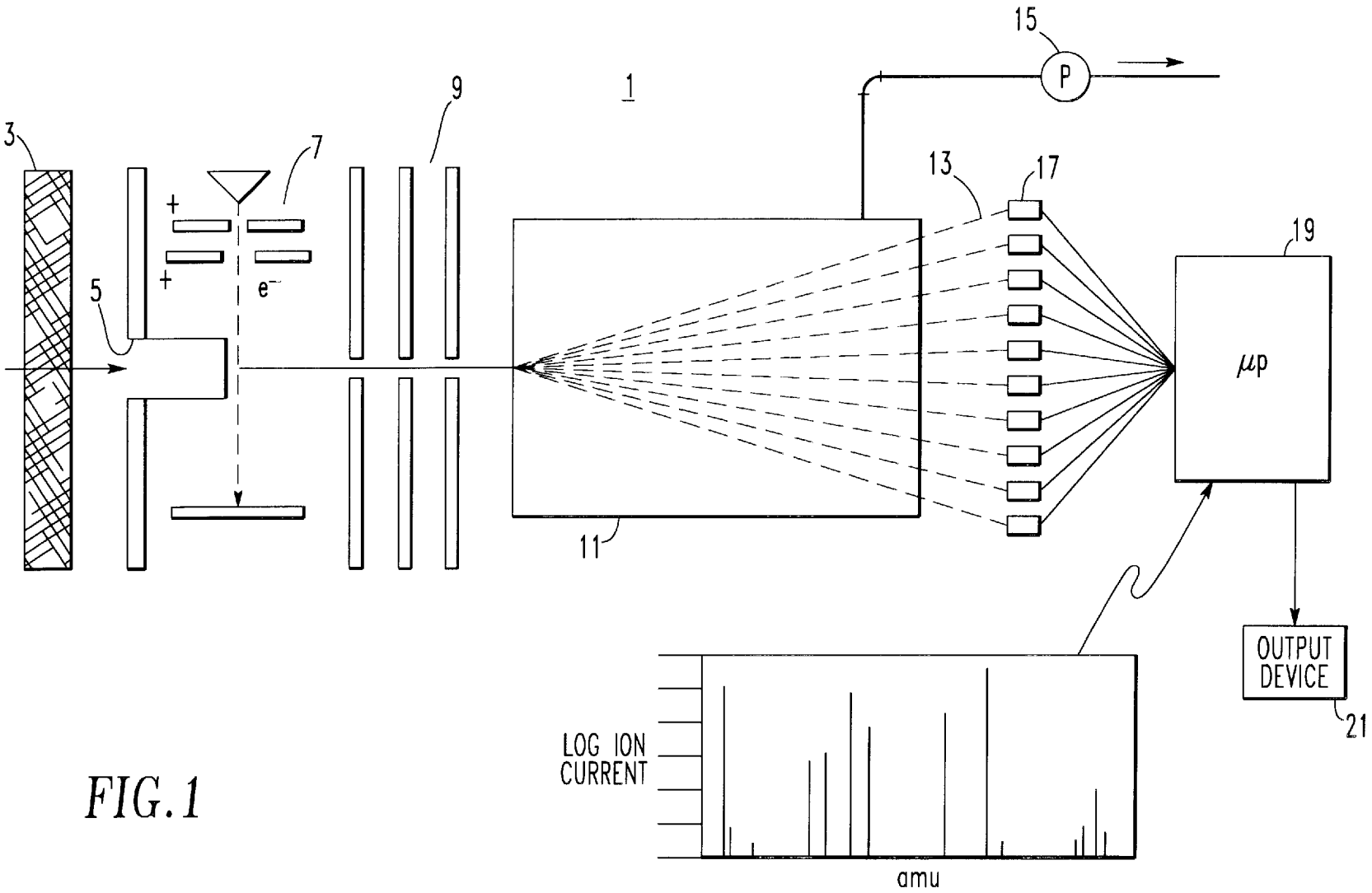
FIG. 1 is a functional diagram of a solid state mass-spectrograph in accordance with the present invention.
Figure 2:
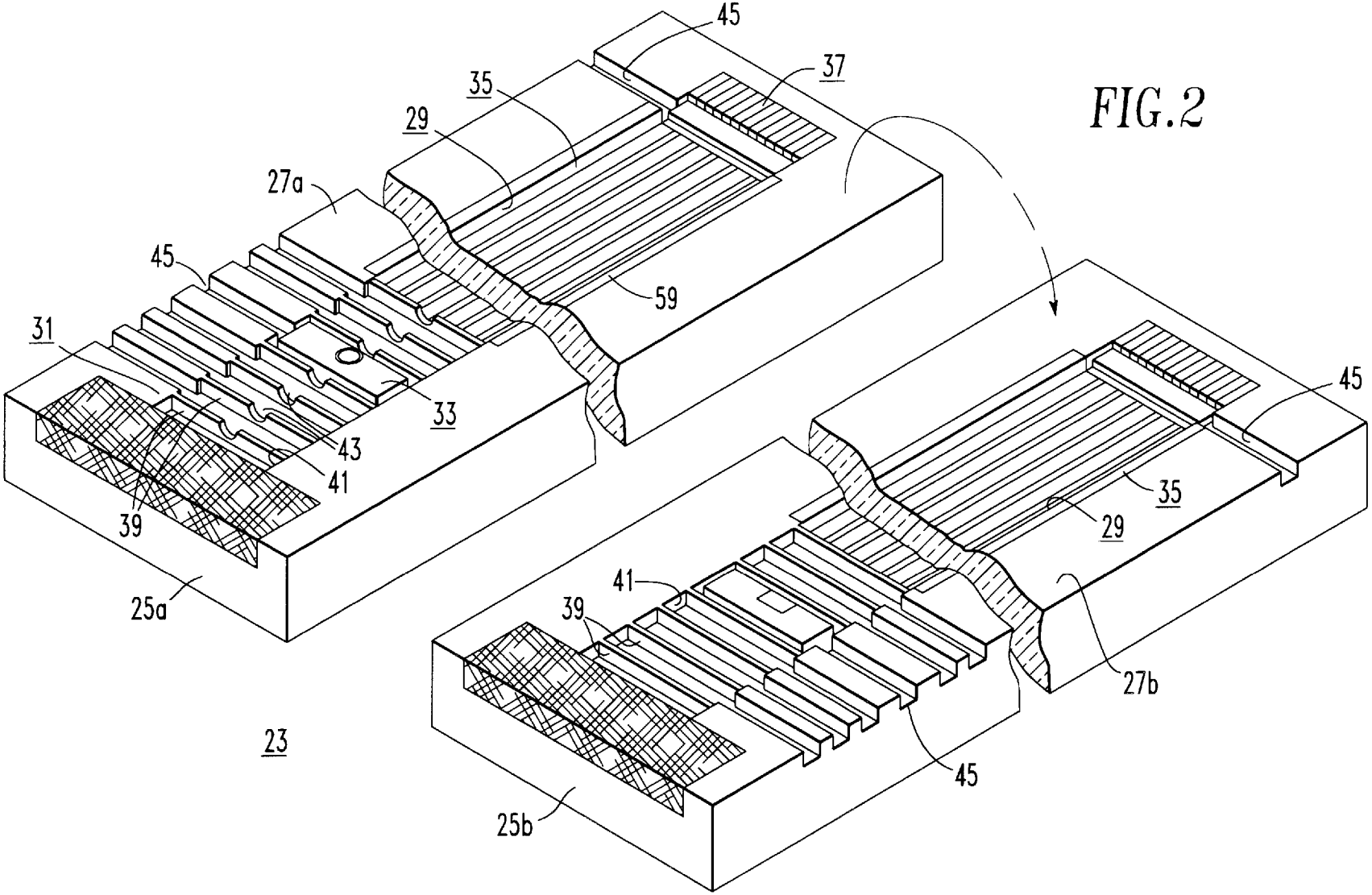
FIG. 2 is an isometric view of the two halves of a mass-spectrograph shown rotated open to reveal the internal structure.
Figure 3:
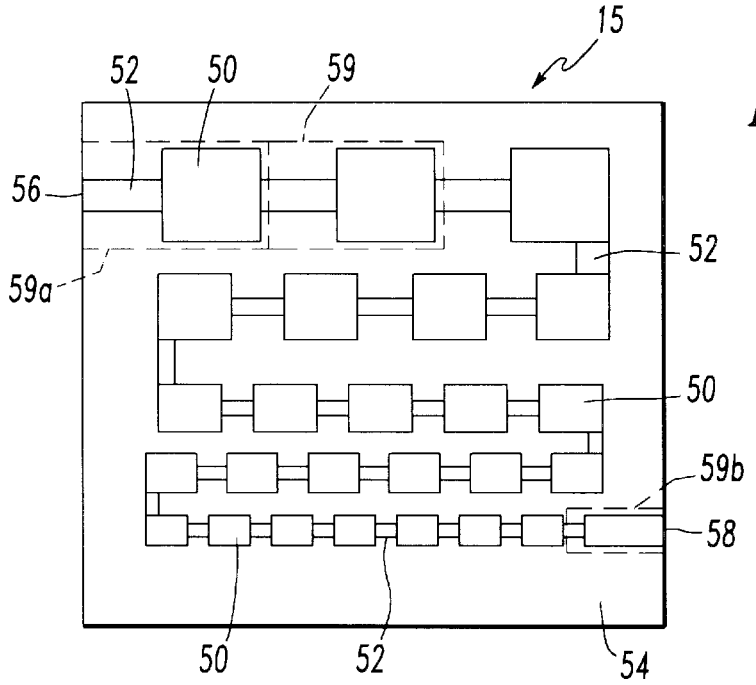
FIG. 3 is a schematic representation of a first embodiment of the micro-machined vacuum pump in accordance with the present invention.

The micro-miniature vacuum pump 15 in accordance with the present invention utilizes thermal transpiration to provide compression. An embodiment of the thermal transpiration vacuum pump 15 is shown in FIG. 3. In particular, a plurality of flow chambers 50 and a plurality of flow tubes 52 are preferably formed into a substrate 54. The substrate 54 is preferably semiconductor material such as silicon, $SiO_2$, gallium arsenide, or silicon carbide.

The flow tubes 52 interconnect the flow chambers 50 as shown. Preferably, each flow chamber 50 is sized such that the gas therein is in a continuum flow regime and each flow tube 52 is sized such that the gas therein is in a free molecular flow regime to provide thermal transpiration.

In particular, the radius of the flow tube 52 is preferably approximately equal to or less than the mean free path length of the gas to provide a free molecular flow regime. If round flow tubes 52 are utilized then a plurality of tubes could interconnect each of the flow chambers 50 to improve the flow of the gas. However, only one or more of the dimensions of the flow tube 52 may be approximately equal to or less than the mean free path length of the gas for thermal transpiration to occur. Therefore, for ease of fabrication on a integrated circuit, it is preferred to implement a rectangular flow tube 52 wherein one dimension, such as the depth, is approximately equal to or less than the mean free path length.

The length of the flow tubes 52 may be varied and mere orifices may be utilized to interconnect adjacent flow chambers 50. Orifices provide minimal resistance to improve throughput but it is preferred to provide a certain length between the flow chambers 50 to reduce heat leakage inasmuch as a temperature differential is required between opposite ends of the flow tube 52 for thermal transpiration to occur.

The vacuum pump 15 is preferably fabricated in a single integrated circuit chip for use with microsensors such as the micro-machined mass spectrograph 1. Specifically, known micro-machining techniques including integrated circuit photolithography permit fabrication of multiple flow chambers 50 and flow tubes 52 on a single integrated circuit chip. In particular, between 30 and 70 flow chambers 50 may be implemented on a single substrate 54 to provide a vacuum pump 15 which may be utilized with a micro-machined mass spectrograph 1 or other microsensors.

Referring to FIG. 3, the vacuum pump 15 includes an inlet port 56 connected to an inlet stage 59*a* for introducing a gas into the vacuum pump 15 at a low pressure. The vacuum pump 15 additionally includes an outlet port 58 connected to an output stage 59*b* for releasing the gas at a higher pressure.

Figure 4:
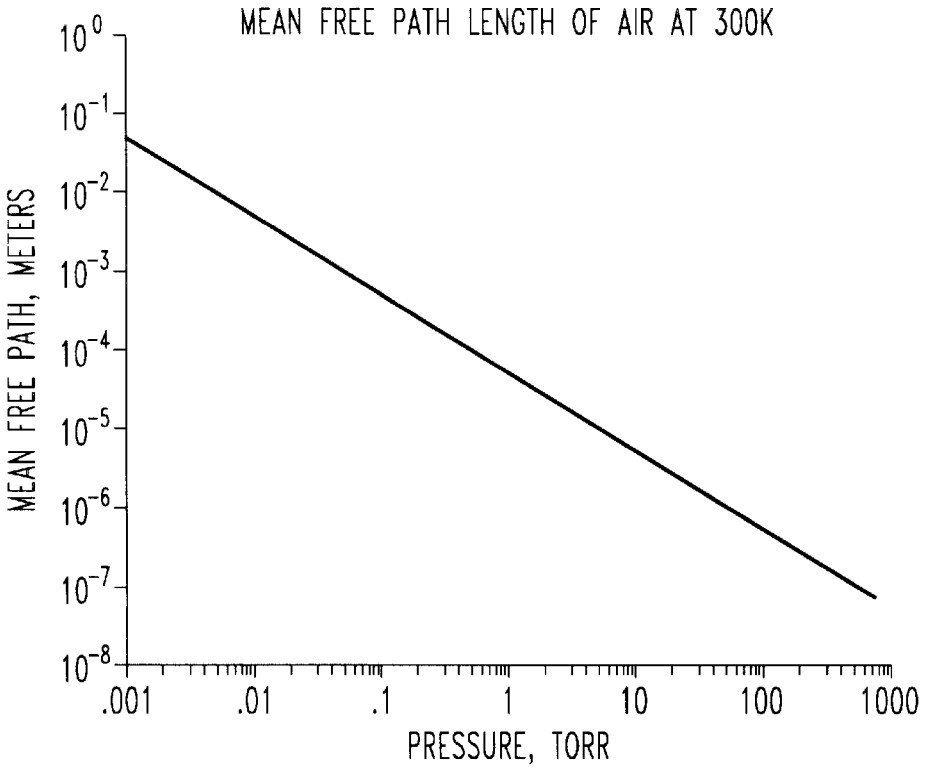
FIG. 4 is a plot showing the mean free path length of air over a range of pressures.

The gas passes through a plurality of stages 59 within the vacuum pump 15. Each stage 59 includes a flow tube 52 and an adjacent flow chamber 50 and each subsequent flow chamber 50 and flow tube 52 may preferably be reduced in size as the gas is compressed. The size of the stages 59 is sequentially reduced because the mean free path length decreases as the pressure s increased as shown in FIG. 4. The typical dimensions used within the micro-machined components range from the sub-micron to thousands of microns. It follows that the free-molecular flow condition (i.e., $R \ll \lambda$) is readily met in the vacuum pump 15 in accordance with the present invention.

Figure 5:
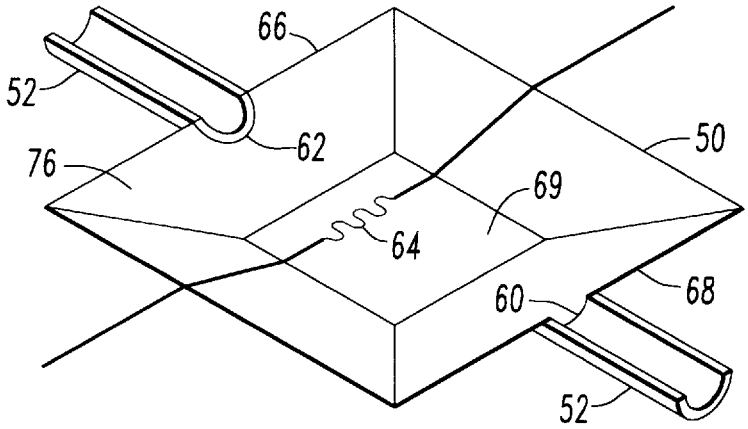
FIG. 5 is a perspective view of one embodiment of a flow chamber and heater within the vacuum pump.

One embodiment of a flow chamber 50 within a vacuum pump 15 in accordance with the present invention is shown in FIG. 5. A temperature differential across the flow tubes 52 is required to induce pumping within the vacuum pump 15. Preferably, a second end 62 of each flow tube 52 may be heated to draw the gas from the first end 60 of a previous stage thereof to the flow chamber 50 adjacent to the second end 62. The pressure within the flow chamber 50 is increased and pumping is induced.

Each flow chamber 50 within the vacuum pump 15 may include a heater 64 preferably adjacent to an inlet side 66 thereof to heat the second end 62 of the adjacent flow tube 52.

Alternative means 64 may be utilized to create a temperature differential across the flow tube 52. For example, each flow chamber 50 may include a cooling apparatus (not shown) adjacent the outlet side 68 thereof for cooling the first end 60 of an interconnected flow tube 52.

The heater 64 may be a thin film resistance heater patterned on the lower surface 69 of the flow chamber 50 within substrate 54. For clarity, only one heater 64 is shown in FIG. 5. It is understood that multiple heaters 64 may alternatively be implemented in other locations, such as within each flow tube 52 or on a lid 70 (FIG. 7) of the vacuum pump 15. A cold portion of each flow tube 52 may be accomplished by attaching a heat sink 72 to the exterior of the substrate 54 also shown in FIG. 7.

The embodiment of the vacuum pump 15 shown in FIG. 5 is advantageous inasmuch as the flow chamber 50 and heater 64 configuration are easy to fabricate. However, most of the heat from the heater 64 is lost because the substrate 54 is in direct contact with the heater 64 and is unnecessarily heated thereby.

Figure 6:
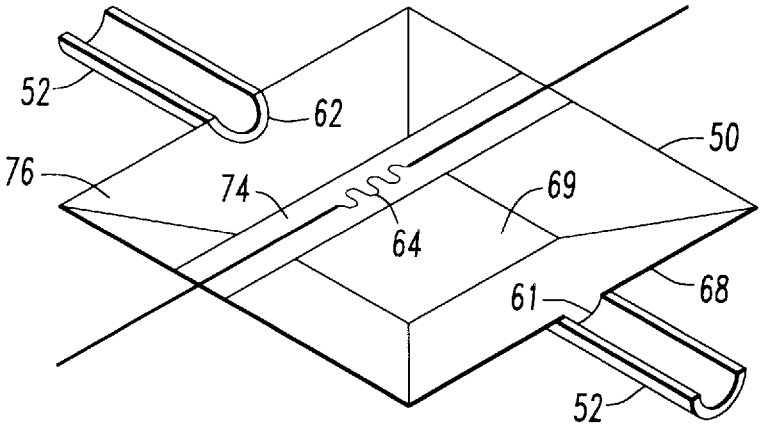
FIG. 6 is a perspective view of a second embodiment of a flow chamber including an air bridge having the heater thereon.

An alternative embodiment of a flow chamber 50 and heater 64 configuration is shown in FIG. 6. Specifically, this embodiment includes an air bridge 74 across the flow chamber 50 and spaced from the lower surface 69 thereof. The heater 64 is preferably placed onto the air bridge 74. This embodiment provides a reduction in power consumption on the order of 10 milliwatts per stage 59 compared with the embodiment shown in FIG. 5. The air bridge 74 and heater 64 thereon may be located adjacent to the second end 62 of the flow tube 52 as shown in FIG. 6, or may alternatively be located over the flow tube 52.

Figure 7:
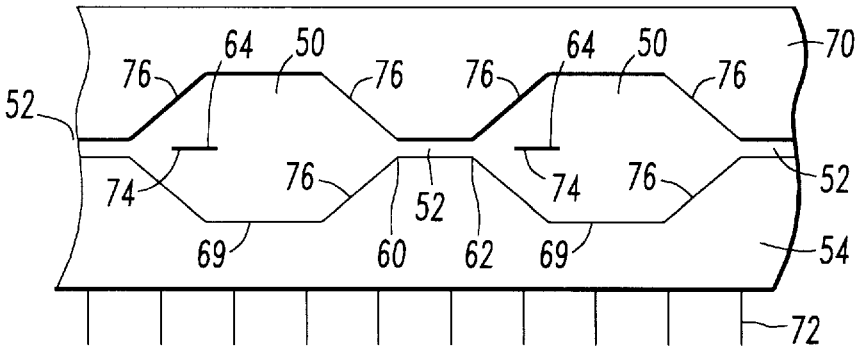
FIG. 7 is a schematic section of the first embodiment of the vacuum pump.

A lid 70 of the vacuum pump 15 is shown in the cross sectional view of FIG. 7. The lid 70 may be utilized to enclose the flow chambers 50 and flow tubes 52. The lid 70 may be formed as another chip which is preferably etched to match the substrate 54 as shown in FIG. 7. In addition, the lid 70 may be formed as a featureless, flat plate if the air bridge 74 and heater 64 thereon are slightly recessed or if the heater 64 is placed directly on the substrate 54. The substrate 54 and lid 70 may be attached by various methods such as anodic bonding, gluing and the like. Alternatively, the vacuum pump 15 may be formed in a monolithic substrate 54.

Referring to FIG. 7, the sidewalls 76 of the flow chambers 50 are shown as sloping. Such sidewalls 76 may be produced by anisotropic etching with KOH. Alternatively, the sidewalls 76 may be curved or perpendicular to the lower surface 69 of the flow chambers 50.

Free molecular flow is largely based upon the shallowest dimension of the flow tube 52 (i.e., the depth characteristic of a rectangular flow tube). Therefore, the flow tubes 52 are preferably rectangular in cross-section to permit the flow tubes 52 to be easily patterned and etched to depths ranging from the sub-micron to hundreds of microns to provide a free molecular flow regime within the flow tubes 52. Alternatively, the flow tubes 52 may include a single circular tube or a plurality of tubes each having a radius preferably approximately equal to or less than the free mean path length of the gas.

Examples of stages 59 of a vacuum pump 15 useable with the micro-machined mass spectrograph 1 follow. Compressing the gas from 3.0 torr to 4.24 torr at a flowrate of $1.8\times10^{-3}$ standard cubic centimeters per minute (sccm) with hot and cold temperatures of 300K and 600K at the respective first end 60 and the second end 62 of a flow tube 52 may be accomplished with a rectangular flow tube 52 being 4 microns deep to satisfy $R \ll \lambda$ and 1290 microns wide and 40 microns long. The flow chamber 50 within the same stage may have a depth equal to or greater than 1670 microns and the width and length of the flow chamber 50 merely satisfy $\lambda \ll L$ although this dimension is not critical.

Compressing the gas from 426 millitorr to 602 millitorr at a flowrate of $1.8\times10^{-4}$ sccm using 300K and 600K temperatures requires a flow tube 52 having depth of 4 microns, a width of 910 microns and a length of 40 microns. In order to satisfy $\lambda \ll L$, the flow chamber 50 within the same stage 59 should have a depth of 1.17 cm, which would require a large substrate 54.

Fortunately, the requirement for $\lambda \ll L$ may be relaxed within the flow chamber 50 by pushing the flow regime into slip (e.g., $\lambda/L=0.2$ as opposed to $\lambda/L<<1$). The flow chamber 50 may then have an acceptable depth of 587 microns. Furthermore, the thermal transpiration effect continues to some degree even if the flow chamber 50 dimensions approach the transition regime ($\lambda/L=1$). Therefore, the flow chamber 50 will continue to operate with a depth of 117 microns. Accordingly, very low pressure vacuum pumps 15 may be fabricated on standard integrated circuit wafers.

Alternatively, the flow chambers 50 are easy to form when the pressure is high but it is more difficult to accomplish the desired $\lambda>>R$ within the flow tubes 52. For example, a rectangular flow tube 52 having a depth of 0.024 microns, length of 0.24 microns and a width of 1.55 cm is required to increase the pressure from 411 torr to 581 torr at 0.018 sccm. A flow tube 52 having a width of 1.55 cm would require a large substrate 54.

Figure 8:
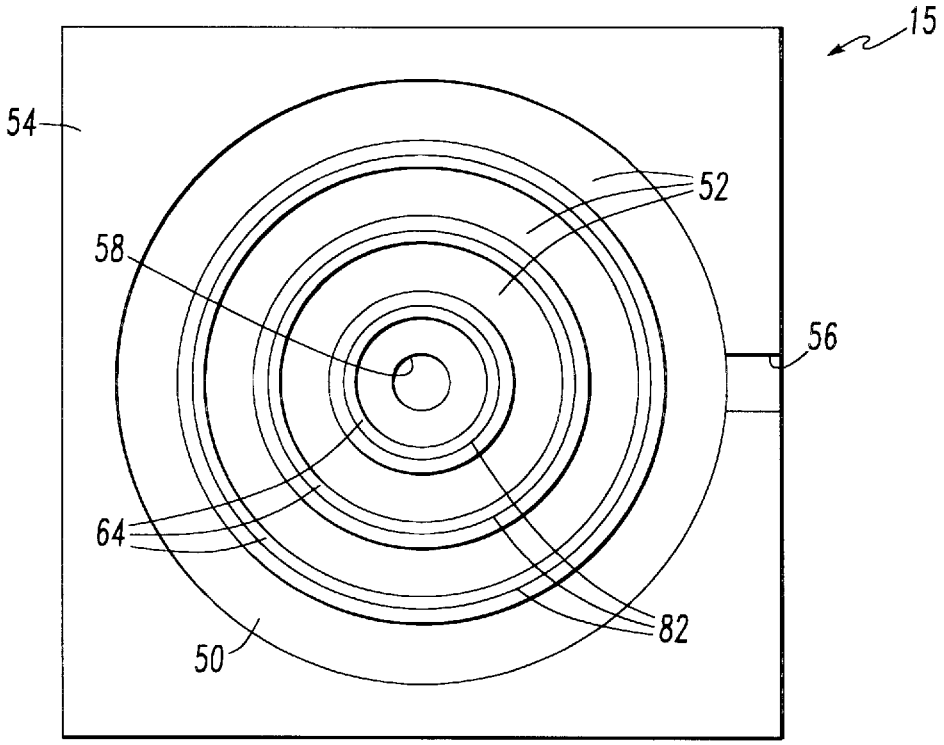
FIG. 8 is a schematic representation of a second embodiment of the vacuum pump.

The utilization of a large substrate 54 may be avoided within the embodiment of the vacuum pump 15 shown in FIG. 8. The embodiment of the vacuum pump 15 shown in FIG. 8 includes a plurality of circular flow chambers 50. A circular flow tube 52 is preferably interposed between adjacent flow chambers 50. Each flow tube 52 in this embodiment may merely include an upper and lower surface between the adjacent flow chambers 50. The upper and lower surfaces may define a depth therebetween which is approximately equal to or less than the mean free path length of the gas to provide a free molecular regime within the flow tubes 52. The width of the flow tube 52 is equal to the circumference of the flow chamber 50.

A heater 64 may be provided within each flow chamber 50 and is preferably adjacent to the inner perimeter 82 of a flow tube 52. The heaters 64 create a temperature differential within the flow tubes 52 to create the pumping action as previously described.

Figure 9:
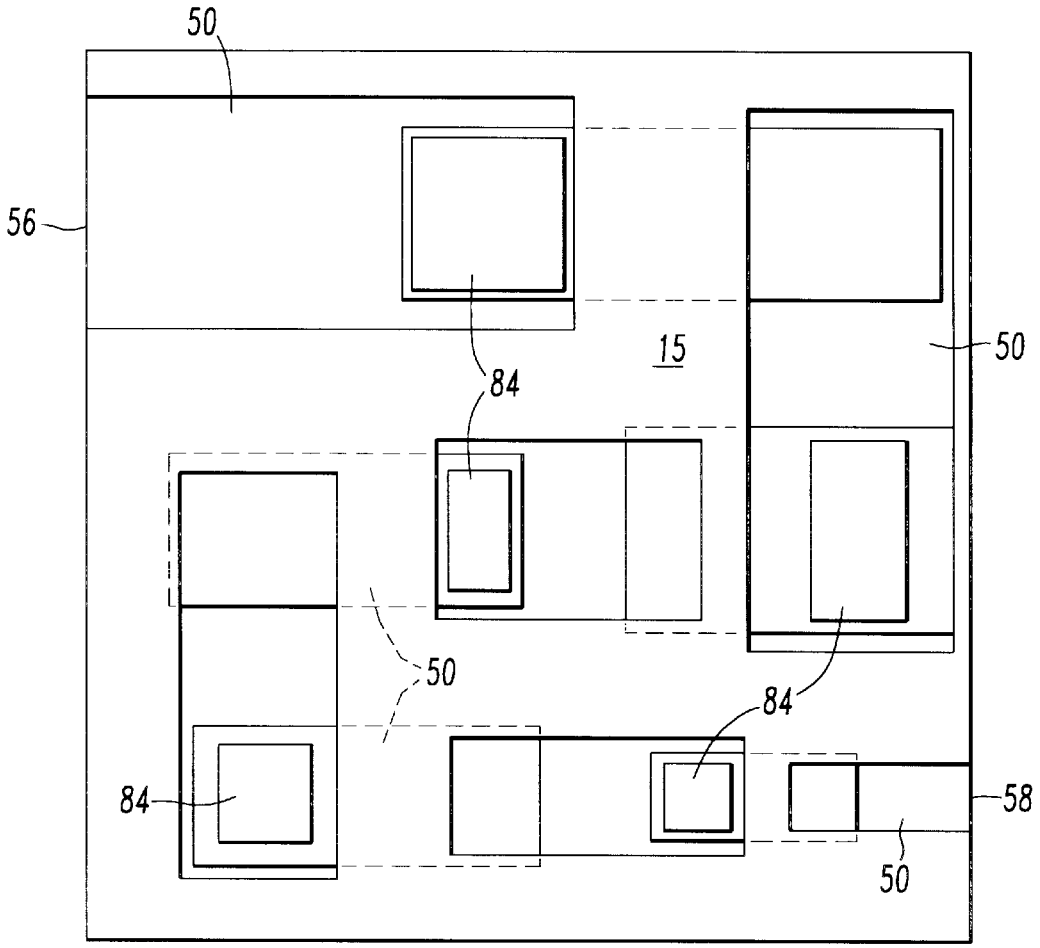
FIG. 9 is a schematic representation of a third embodiment of the vacuum pump.
Figure 10:
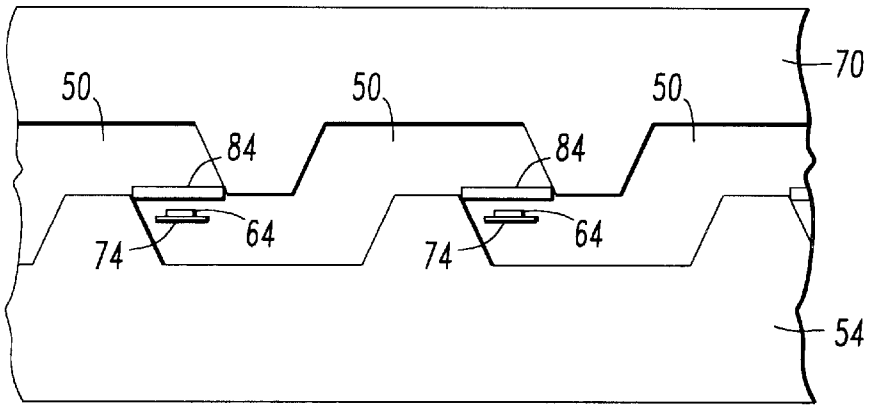
FIG. 10 is a schematic section of the third embodiment of the vacuum pump.

A third embodiment of the vacuum pump 15 in accordance with the present invention is shown in FIG. 9 and FIG. 10. The vacuum pump 15 includes a plurality of flow chambers 50. The flow chambers 50 may overlap to a certain degree as shown in FIG. 9 and FIG. 10. Each flow tube in this embodiment may be a porous film membrane 84 which includes a plurality of round orifices. Preferably, the round orifices each have a radius which is approximately equal to or less than the mean free path length of the gas. Heaters 64 may be positioned on an air bridge 74 adjacent the porous film membrane 84 as shown in FIG. 10.

A porous film membrane 84 may be utilized to improve the pumping within the vacuum pump 15 at high pressures. In particular, a 61 micron by 61 micron porous film membrane 84 may match the same compression and flowrate as the 1.55 cm by 0.024 micron by 0.24 micron rectangular flow tube 52. Such a porous film membrane 84 is 0.24 microns deep and includes approximately 203,000 small holes each having a radius of approximately 0.024 microns.

Generally, any of the embodiments of the vacuum pump shown in FIG. 3, FIG. 8 or FIG. 9 may be utilized with a microsensor. However, the embodiments shown in FIG. 8 and FIG. 9 may preferably be utilized in applications having higher pressures and/or when higher flow levels are required.

A micro-machined thermal transpiration vacuum pump 15 fabricated on substrate 54 in accordance with the present invention provides the advantage of having no moving parts. Accordingly, there is no component wear within the thermal transpiration vacuum pump 15 and the reliability of the vacuum pump 15 is increased. Power losses due to friction are eliminated and there are no rotating or sliding feedthroughs within the vacuum pump 15. Therefore, seals which may leak are also eliminated. There can be no particulate fouling inasmuch as there are no rubbing parts within the vacuum pump 15.

The vacuum pump 15 in accordance with the present invention also provides the additional advantage of being a dry pump. Therefore, no oil is used within the pump and the need for cold traps to prevent oil back-streaming into the microsensor or other components is eliminated. Furthermore, there is no concern of the oil aging or reacting with the gases being pumped. The vacuum pump 15 may also operate in any orientation.

The vacuum pump 15 in accordance with the present invention requires no valves to accomplish compression. Therefore, the reliability of the vacuum pump 15 is increased, pulsations in the pressure and flow of the gas are eliminated, and the vacuum pump 15 is silent.

The vacuum pump 15 may also be self-priming from below 10 millitorr up to atmospheric pressure and no fore pump is needed. For example, the flow chambers 50 and flow tubes 52 are typically at an initial pressure of atmospheric when the vacuum pump 15 is turned on. The vacuum pump 15 may be made self-priming by first powering the stage **59*b* closest to the outlet port 58. The outlet port 58 draws the gas out of and reduces the pressure within the upstream stages 59**.

An adjacent stage 59 may become operational once the pressure is sufficiently reduced and the adjacent stage 59 begins to draw gas from the remaining upstream stages 59. The adjacent stage 59 rejects the gas therein at a subatmospheric pressure to the last stage **59*b* which expels the gas to the atmosphere via outlet port 58**.

The next upstream stage 59 will become operational once the adjacent stage 59 has sufficiently reduced the pressure. The process is repeated until each stage 59 within the vacuum pump 15 is operating within its designed pressure regime.

The stages 59 within the vacuum pump 15 additionally provide a system of redundancy inasmuch as each particular stage 59 provides a portion of the compression. Therefore, the vacuum pump 15 will not fail if there is failure of any one stage 59 and only an incremental decrease in pumping action occurs.

The vacuum pump 15 may be utilized with all types of gases. In particular, the heater 64 and other components within the vacuum pump 15 may be encased within an inert film such as silicon nitride if corrosive gases will be pumped. Further, the vacuum pump 15 provides improved pumping for lighter gases such as hydrogen gas and helium.

While preferred embodiments of the invention have been shown and described herein, it will be appreciated by those skilled in the art that various modifications and alternatives to the disclosed embodiments may be developed in light of the overall teachings of the disclosure. Accordingly, the disclosed embodiments are meant to be illustrative only and not limiting to the scope of the invention which is to be given the full breadth of the following claims and all equivalents thereof.

I claim:

1. A pump for use in a solid state microsensor for analyzing a sample fluid, the microsensor being formed from a semiconductor substrate having an inlet and said pump being connected thereto, said pump comprising:

a semiconductor substrate having a plurality of flow chambers, the area of said flow chambers being of progressively smaller size, and a plurality of flow tubes to interconnect the flow chambers, at least one dimension of each of said flow tubes being approximately equal to or less than the mean free path length of the fluid; and means for creating a temperature differential between a first end and a second end of each of said flow tubes to draw the fluid therethrough.

2. The pump of claim 1 wherein said means includes a heater adjacent to the second end of each of said flow tubes for applying heat thereto.

3. The pump of claim 1 wherein each of said flow tubes has a rectangular cross section.

4. The pump of claim 2 wherein each of said flow chambers includes an air bridge to support said heater.

5. The pump of claim 1 further comprising a heat sink connected to said semiconductor substrate to dissipate heat therein to create a temperature differential across each of said flow tubes.

6. The pump of claim 1 wherein said flow chambers are concentric circles.

7. The pump of claim 1 wherein said semiconductor substrate includes a lid to enclose said flow chambers and said flow tubes.

8. A The pump of claim 1 wherein each of said flow tubes is a porous film membrane.

9. The pump of claim 2 wherein each of said flow tubes has a rectangular cross section and at least one dimension thereof is approximately equal to or less than the mean free path length of the fluid.

10. A pump for use with a microsensor, comprising:

a semiconductor substrate having an inlet port for receiving a fluid at a first pressure and an outlet port for releasing the fluid at a second pressure;

said semiconductor substrate having a plurality of interconnected stages;

each of said stages includes a flow tube connected at a second end thereof to a flow chamber, the area of each said stage being of progressively smaller size and, at least one dimension of said flow tube being approximately equal to or less than the mean free path length of the fluid, and means for creating a temperature differential between a first end and the second end of said flow tube; and wherein the inlet port is connected to an input stage and the outlet port is connected to an output stage.

11. The pump of claim 10 wherein said means includes a heater adjacent to the second end of each said flow tube for applying heat thereto.

12. The pump of claim 10 wherein each said flow tube has a rectangular cross section.

13. The pump of claim 11 wherein each said flow chamber includes an air bridge to support said heater.

14. The pump of claim 10 further comprising a heat sink connected to said semiconductor substrate to dissipate heat therein to create a temperature differential across each said flow tube.

15. The pump of claim 10 wherein each said flow chamber is a concentric circle.

16. The pump of claim 10 wherein said semiconductor substrate includes a lid to enclose said stages.

17. The pump of claim 10 wherein each said flow tube is a porous film membrane.

18. The pump of claim 10 wherein each said flow tube has a rectangular cross section and at least one dimension thereof is approximately equal to or less than the mean free path length of the fluid.

* * * * *